US007162769B2

(12) United States Patent
Tratter

(10) Patent No.: US 7,162,769 B2
(45) Date of Patent: Jan. 16, 2007

(54) ARTICULATED JOINT TO JOINT TUBES WITH TWO DUCTS, PARTICULARLY FOR A SUCTION, STEAM PRODUCTION AND/OR CLEANING APPARATUS

(75) Inventor: Gerard Tratter, Trento (IT)

(73) Assignee: Gioel Italia '96 S.r.L., Trento (IT)

( * ) Notice: Subject to any disclaimer, the term of this patent is extended or adjusted under 35 U.S.C. 154(b) by 329 days.

(21) Appl. No.: 10/450,387

(22) PCT Filed: Nov. 21, 2001

(86) PCT No.: PCT/IT01/00583

§ 371 (c)(1),
(2), (4) Date: Jun. 13, 2003

(87) PCT Pub. No.: WO02/47528

PCT Pub. Date: Jun. 20, 2002

(65) Prior Publication Data

US 2004/0045120 A1 Mar. 11, 2004

(30) Foreign Application Priority Data

Dec. 15, 2000 (IT) ..... RM2000A0670

(51) Int. Cl.
*A47L 9/24* (2006.01)

(52) U.S. Cl. ..... 15/321; 285/7; 285/184; 285/185

(58) Field of Classification Search ..... 15/321, 15/322, 414; 285/7, 181, 184, 185, 272
See application file for complete search history.

(56) References Cited

U.S. PATENT DOCUMENTS 1,042,713 A * 10/1912 Moorhead ..... 15/322
1,066,201 A * 7/1913 Fulper ..... 15/322
1,765,693 A * 6/1930 Muend ..... 285/181
2,011,446 A * 8/1935 Judell ..... 4/570
4,639,018 A * 1/1987 Froelich et al. ..... 285/184
4,717,180 A * 1/1988 Roman ..... 285/148.19
4,998,317 A 3/1991 Passien
5,113,547 A * 5/1992 Mayhew ..... 15/322
5,358,352 A 10/1994 Klarhorst
6,336,764 B1 * 1/2002 Liu ..... 401/289
2002/0101075 A1 * 8/2002 Park et al. ..... 285/7

FOREIGN PATENT DOCUMENTS

| | | |
|---|---|---|
| DE | 85 23 910 | 7/1994 |
| EP | 0 032 360 | 7/1981 |
| EP | 0 567 044 | 10/1993 |
| FR | 2 772 585 | 6/1999 |

* cited by examiner

*Primary Examiner*—Terrence R. Till
(74) *Attorney, Agent, or Firm*—Young & Thompson

(57) ABSTRACT

The invention relates to an articulated joint (1) to joint tubes with two ducts (2, 3), particularly for a suction, steam production and/or cleaning apparatus, comprising a central portion (4), provided with a rotation system with maximum angle of 170°, a front body (5) and a rear body (6), carrying suction, steam production and/or cleaning ducts (2, 3), the passage of steam and/or cleaning products occuring through a front duct (7) and a rear duct (8), said front duct (7) and rear duct (8) having one end within watertight means, provided in said central part (4), allowing the passage of steam and/or cleaning product, and at the same time allowing the rotation of the articulated joint (1) in every position.

13 Claims, 6 Drawing Sheets

ARTICULATED JOINT TO JOINT TUBES WITH TWO DUCTS, PARTICULARLY FOR A SUCTION, STEAM PRODUCTION AND/OR CLEANING APPARATUS

BACKGROUND OF THE INVENTION

The present invention relates to an articulated joint to joint tubes with two ducts, particularly for a suction, steam production and/or cleaning apparatus.

More particularly, the invention concerns to an articulated joint of the above kind, suitably studied to obtain a movement between attachments provided with two ducts, one for suction and the other one to transport fluids outward (steam, water, detergents) on a plane in the space of about 170°.

At present, among the products/machines for cleaning and hygienisation, thus operating by a combined suction, steam production and/or cleaning by a detergent system, no element exists allowing obtaining a movement between two attachments provided with two ducts.

In the field of the traditional suction systems, i.e. classic vacuum cleaner, at present only one element exists, manufactured by Vorwerk, that in any case, can be only used to suck, and that does not provide any passage for steam and/or other exiting liquids, and allows only a trigger action (frictioned) between the two movable parts.

On the other side, it is well evident to all those skilled in the art, that the needing exists to have an articulated joint as suggested according to the present invention, allowing to obtain a movement between attachments provided with two ducts, one for the suction and the other one to transport fluids (steam, water, detergents) outwards on a plane in the space of about 170°.

SUMMARY OF THE INVENTION

It is the object of the present invention that of providing an articulated joint that allows to position the attachments with the wished inclination within an angle of 170°, thus being possible to operate on surfaces that otherwise would not be possible to reach, such as planes above, under or aside furniture; to maintain a proper position of an attachment in case movements must be made for the cleaning up and down, as it occurs for cleaning glasses; to reach difficult places, under the bed, simply lowering the handle, for example employing the rectangular brush.

Another object of the present invention is that of providing a solution very simple to employ, since, to choose the wished function, it is sufficient to act on a lever and carry out a rotation.

It is therefore specific object of the present invention an articulated joint to joint tubes with two ducts, particularly for a suction, steam production and/or cleaning apparatus, comprising a central portion, provided with a rotation system with maximum angle of 170°, a front body and a rear body, carrying suction, steam production and/or cleaning ducts, the passage of steam and/or cleaning products occurring through a front duct and a rear duct, said front duct and rear duct having one end within watertight means, provided in said central part, allowing the passage of steam and/or cleaning product, and at the same time allowing the rotation of the articulated joint in every position.

In a first embodiment of the articulated joint according to the invention, said watertight means can be comprised of a watertight chamber placed in said central part.

In a second embodiment of the articulated joint according to the invention, said watertight means can be comprised of a hose connecting the two front and rear ducts, and that can follow all the rotations of the articulated joint.

According to a further embodiment of the articulated joint according to the invention, said watertight means can be realised placing a hose within the suction duct.

Preferably, according to the invention, said rotation system of the central part can provide a lever, with a possible esthetical cover, a centrally placed stop disc, an intermediate disc, determining, in function of the lever position, the kind of articulated joint rotation, a dampening element, or rubber element, placed in the zone contacting said stop and intermediate discs, elastic means, to transmit the motion from the lever and the determination of the position of said discs each other, a central pin, about which the movement parts rotate.

Particularly, according to the invention, said lever permits three operating modes, and specifically, free rotation, frictioned rotation and locked rotation.

Furthermore, according to the invention, said watertight chamber can be placed within said steam hub.

Still according to the invention, said front and rear ducts can be comprised of plastic material, by a gas injection technique.

Always according to the invention, a steam hub for the passage of the steam through the articulated joint is provided in said central part, between said front and rear ducts.

Further, according to the invention, said articulated joint can be realised separated, and thus coupled with the elements of the suction, steam production and/or cleaning apparatus, or it can be integral with one of said attachments.

BRIEF DESCRIPTION OF THE DRAWINGS

The present invention will be now described, for illustrative but not limitative purposes, according to its preferred embodiments, with particular reference to the figures of the enclosed drawings, wherein.

DESCRIPTION OF THE PREFERRED EMBODIMENTS

Figure 1:
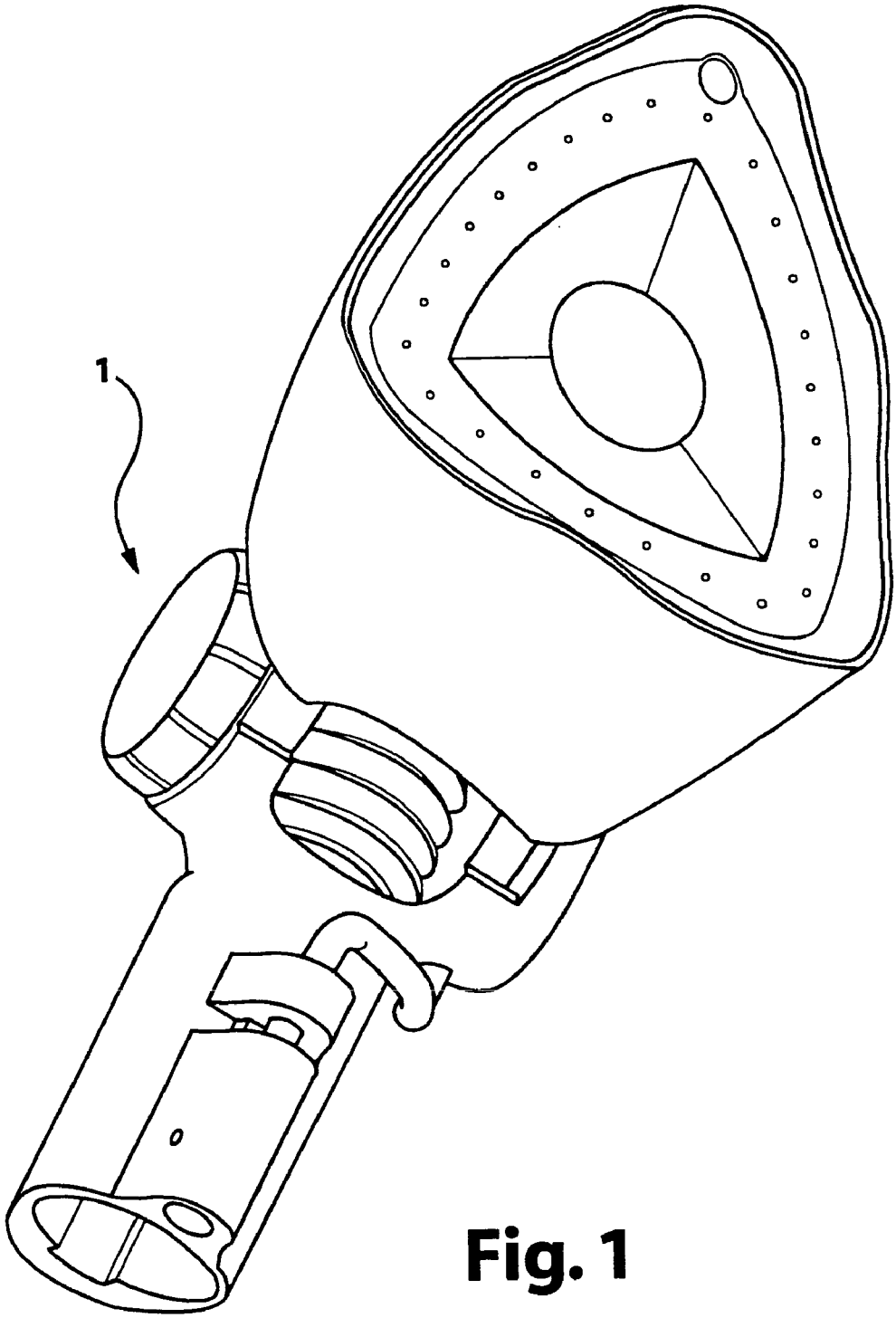
FIG. 1 is a perspective view of an articulated joint according to the invention, applied on an attachment.
Figure 2:
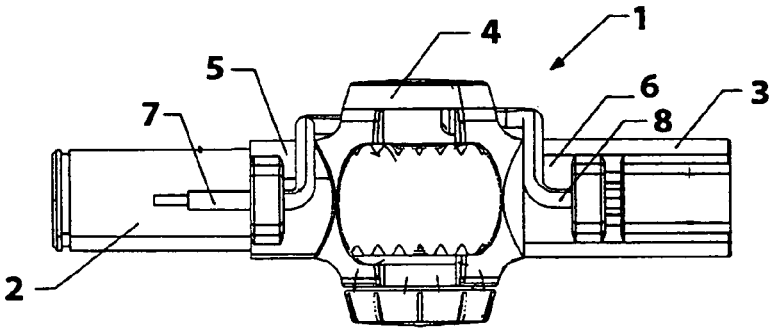
FIG. 2 is a bottom view of an embodiment of the articulated joint according to the invention.

Observing now all the figures of the enclosed drawings, it is shown an articulated joint 1 according to the invention, for the articulation of two ducts 2, 3, used both for suction and for transportation outward of fluids such as water, steam, detergents.

As it can be noted from the enclosed figures, articulated joint 1 according to the invention provides three main parts, respectively the central part 4, providing the rotation system with a maximum angle of 170°, and having on its sides the connection system for the extensions and/or attachments, and the front 5 and rear 6 body, from which the ducts 7, 8 begin, for the transportation of steam, that in the central zone 1 disappear, thus creating a single block with the motion system.

Particularly, motion system of the articulated joint 1 according to the invention provides a lever 9, with the relevant cover 10, allowing the choice among three different rotation possibilities of the articulated joint 1, i.e., free rotation, frictioned rotation and locked rotation.

It is further provided a stop disc 11, placed in the central part 4 that, by an axial movement, allows blocking the articulated joint 1.

Between stop disc 11 and lever 9 an intermediate disc 12 is provided, that, in function of the position established by the operation lever 9, imposes a free of frictioned rotation.

The contact between discs 11 and 12 a rubber element 13 is placed, in their contact zone, having the main function of uniformly distributing the pressure acting on two discs.

It is further provided a Spring 14, transmitting the motion to the operation lever 9 and determining the position each other of discs 11, 12, thus allowing the three possible movements already described.

A central pin 15, or pulling pin, is the axis about which the two parts rotate during their motion.

Duct for the passage of steam is obtained through two plastic material tubes 7, 8 (see also FIGS. 4–8 and 9–13, respectively). Said tubes are realised by the gas injection technique, and communicate with a movable part or steam hub 16, through which the passage of the steam from one side to the other of the articulated joint 1 is obtained.

By the reference number 17, a rubber bellow is indicated, creating a channel for the suction passage, thus allowing its rotation.

Being the operation lever integral with the pulling pin 15 and the cover 10, it is actuated directly by the latter.

The movement system is realised in such a way that, rotating clockwise the operation lever 9 of about 15°, the system only moves with the established angles (frictioned operation).

In this case, an interference exists between the lever 9 and the intermediate 12. The integral motion of the two components 9, 12 induces the trigger rotation of the stop disc 11, and consequently of the articulated joint 1.

By a further movement of the same angle of the lever 9, the complete block of the movement is obtained.

When the articulated joint 1 is in the fixed position, lever 9 is subjected to an interference with the stop disc 11. Integral coupling of the two elements 9, 11 is such to prevent every rotation, since disc 11 is locked on the articulated joint 1 body.

A following further rotation of 15° of the lever 9, always in the clockwise direction, allows to the system to automatically free, thus allowing every rotation of the articulated joint 1.

Figure 3:
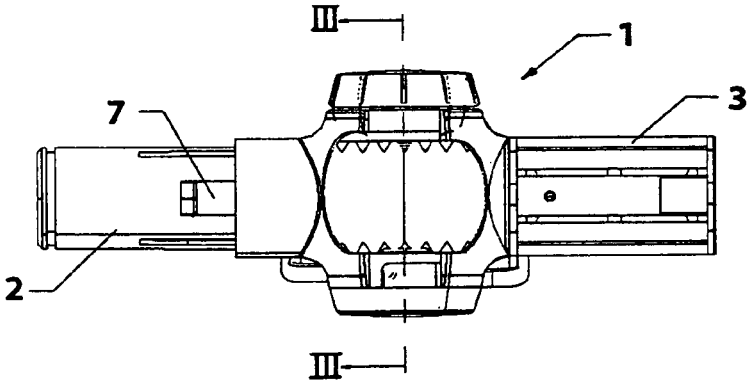
FIG. 3 is a top view of the articulated joint of FIG. 1.
Figure 4:
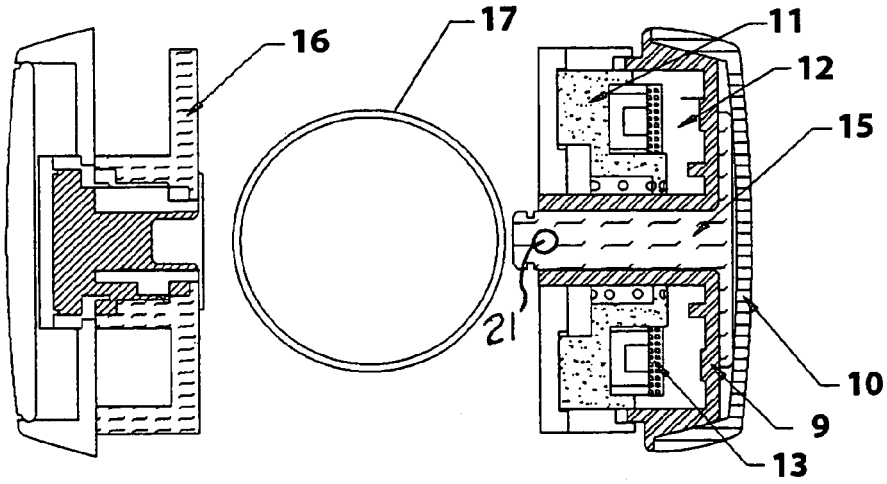
FIG. 4 is an exploded section view taken along line IV—IV of FIG. 3.
Figure 5:
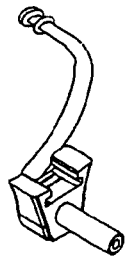
FIG. 5 is a perspective view of the front steam tube of the articulated joint according to the invention.
Figure 6:
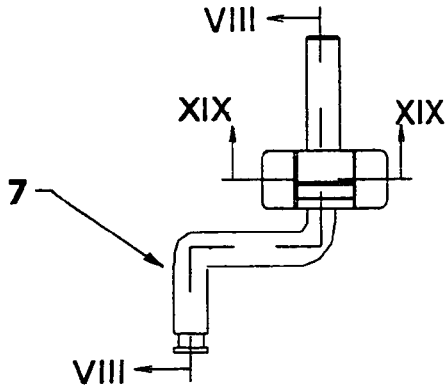
FIG. 6 is a top view of the tube of FIG. 5.
Figure 7:
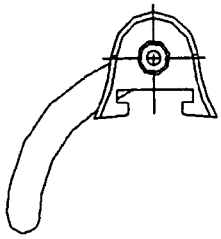
FIG. 7 is a front view of the tube of FIG. 5.
Figure 8:
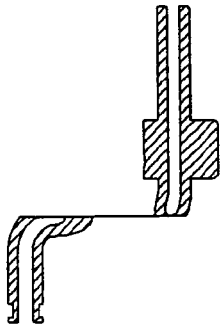
FIG. 8 is a section taken along line VIII—VIII of FIG. 6.
Figure 9:
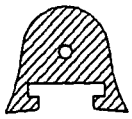
FIG. 9 is a section view taken along line IX—IX of FIG. 6.
Figure 10:
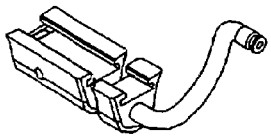
FIG. 10 is a perspective view of the rear steam tube of the articulated joint according to the invention.
Figure 11:
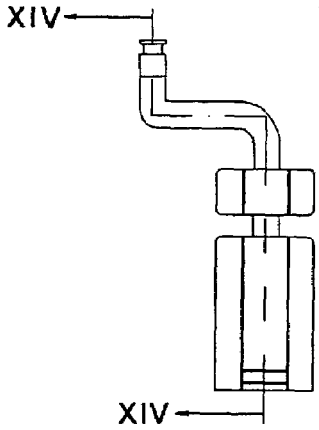
FIG. 11 is a top view of the tube of FIG. 10.
Figure 12:
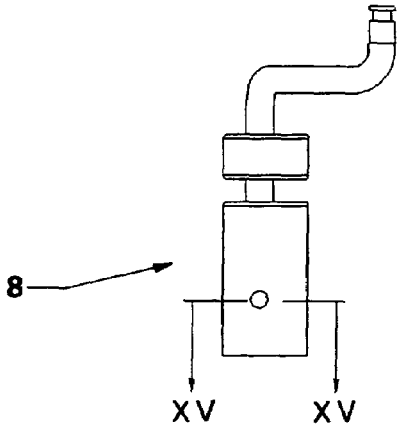
FIG. 12 is a side view of the tube of FIG. 10.
Figure 13:
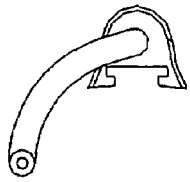
FIG. 13 is a front view of the tube of FIG. 10.
Figure 14:
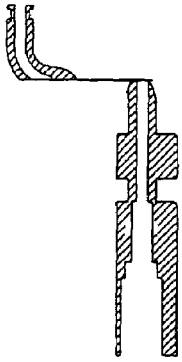
FIG. 14 is a section view taken along line XIV—XIV of FIG. 11.
Figure 15:
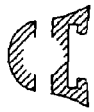
FIG. 15 is a section view taken along line XV—XV of FIG. 11.

This kind of situation is particularly represented in FIG. 3, showing how, by the free movement of the body, the lever 9 is not subjected to any interference.

Lever 9 can cover a 360° angle, the choice of the kind of rotation of the articulated joint 1 being obtained by progressive rotations of the control member, always in a clockwise direction.

The three movements are obtained by a periodicity of rotation on the lever 9 of about 45°.

Figure 16:
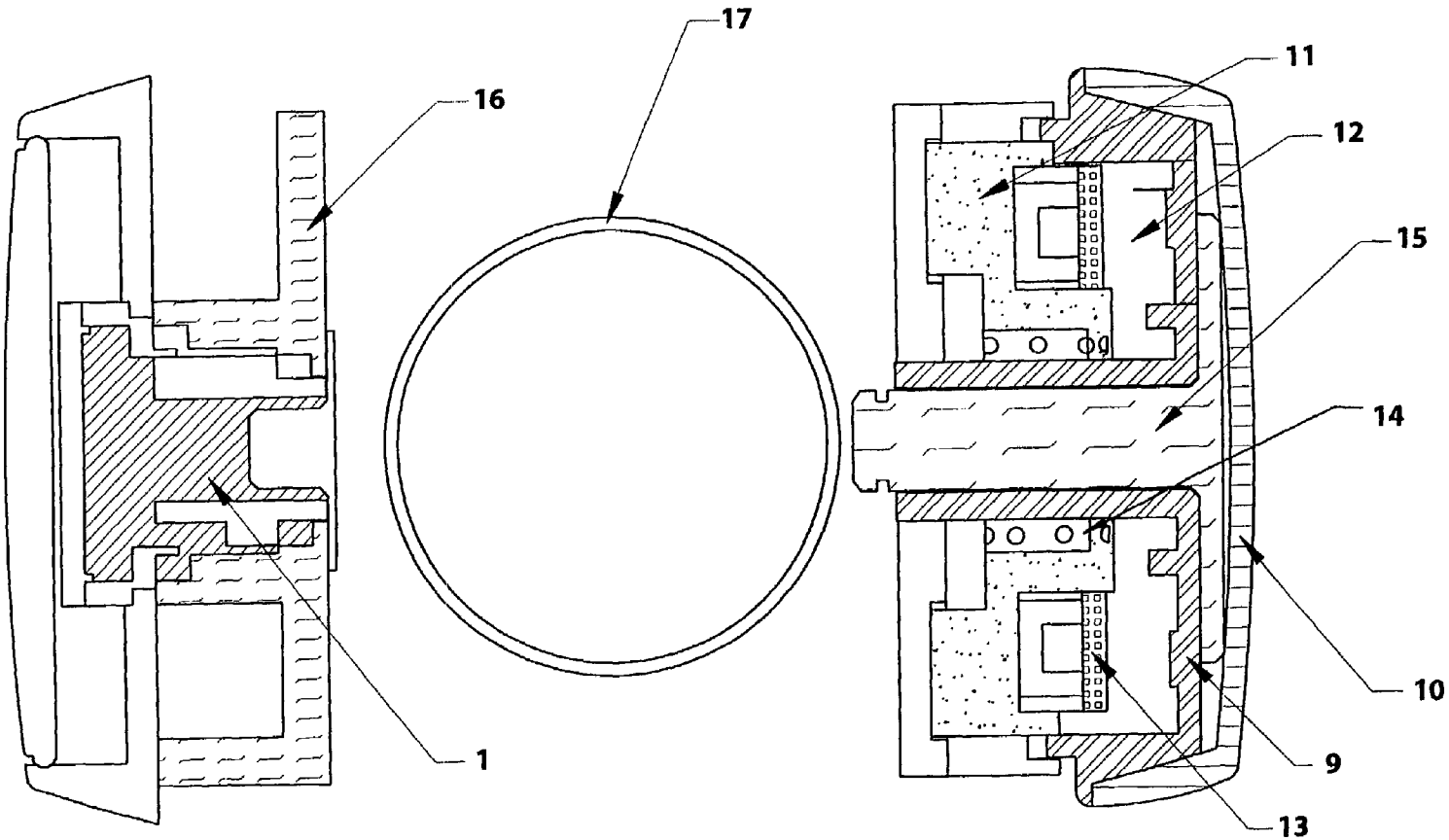
FIG. 16 is an exploded section view of a second embodiment of the articulated joint according to the invention.

The embodiment of the articulated joint 1 according to the invention shown in FIG. 16 provides a rotation of the lever 9 along a 45° arc, so that every 15° step determines the selection of an operative position.

Obviously, all the movements of the lever 9 are transferred to the inner discs 11, 12 through the spring 14, adjusting the position each other of the same, thus allowing three different movement modes.

As already said, steam passage is obtained by the feeding of a watertight chamber provided about the central pin 15. This watertight reservoir is fed by the front steam duct 7, while subsequently the rear duct 8 takes the steam independently from the sloping of the articulated joint 1.

Figure 17:
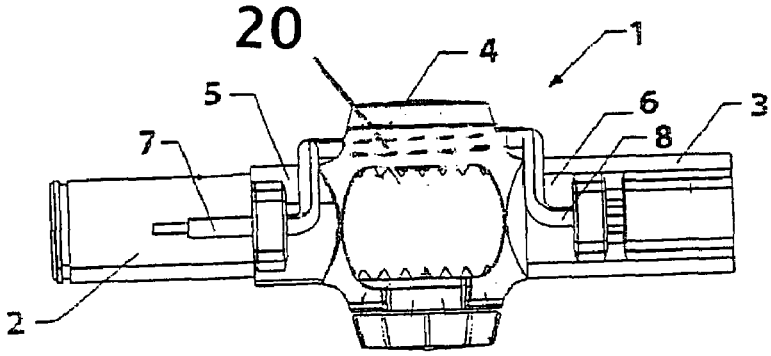
FIG. 17 is a perspective view of an embodiment of the present invention showing the base.

As already said, instead of the watertight chamber, a hose 20 (FIG. 17) can be provided, coupling the two front and rear ducts 7, 8, and that can follow all the rotations of the articulated joint 1.

Further, it is possible to allow the entrance and outlet of fluid from steam ducts 7, 8 at the end of the central pin 15, passing in this case from one side to the other one of the articulated joint 1. Central pin 15 is hollow (as indicated by circle 21 in FIG.4), and communicate the two ducts 7, 8, closing the circuit and following all the rotations of the attachment.

A further possibility for the passage of the steam is to position the hose within the suction duct.

Outer tubes for the adduction of the steam can be realised, besides employing the gas injection method, by employing suitably shaped aluminium ducts.

Articulated joint 1 is manufactured as a single object or integrally mounted on some other attachments for this kind of apparatus, such as the so-called "third hand" and the rectangular brush.

The present invention has been described for illustrative but not limitative purposes, according to its preferred embodiments, but it is to be understood that modifications and/or changes can be introduced by-those skilled in the art without departing from the relevant scope as defined in the enclosed claims.

The invention claimed is:

1. An articulated joint to joint tubes with two ducts, comprising:

a central portion provided with a rotation system with maximum angle of 170 °;

a front body and a rear body carrying suction, steam production and/or cleaning ducts, the passage of steam and/or cleaning products occurring through a front duct and a rear duct, said front duct and rear duct having one end within watertight means provided in said central portion, allowing the passage of steam and/or cleaning product, and at the same time allowing the rotation of the articulated joint in every position, wherein said watertight means are comprised of a hose connecting the front and rear ducts and that can follow all the rotations of the articulated joint.

2. The articulated joint according to claim 1, wherein said front and rear ducts are comprised of plastic material, by a gas injection technique.

3. The articulated joint according to claim 1, wherein said articulated joint is coupled with at least one of the elements of the suction, steam production and/or cleaning apparatus.

4. An articulated joint to joint tubes with two ducts, comprising:

a central portion provided with a rotation system with maximum angle of 170 °;

a front body and a rear body carrying suction, steam production and/or cleaning ducts, the passage of steam and/or cleaning products occurring through a front duct and a rear duct, said front duct and rear duct having one end within watertight means provided in said central portion, allowing the passage of steam and/or cleaning product, and at the same time allowing the rotation of the articulated joint in every position, wherein inlet and outlet of fluid from the front and rear ducts occurs through the end of a central pin, passing from one side to the other one of the articulated joint.

5. The articulated joint according to claim 4, wherein said front and rear ducts are comprised of plastic material, by a gas injection technique.

6. The articulated joint according to claim 4, wherein said articulated joint is coupled with at least one of the elements of the suction, steam production and/or cleaning apparatus.

7. An articulated joint to joint tubes with two ducts, comprising:

a central portion provided with a rotation system with maximum angle of 170 °;

a front body and a rear body carrying suction, steam production and/or cleaning ducts, the passage of steam and/or cleaning products occurring through a front duct and a rear duct, said front duct and rear duct having one end within watertight means provided in said central portion, allowing the passage of steam and/or cleaning product, and at the same time allowing the rotation of the articulated joint in every position, wherein said rotation system includes a lever, a centrally placed stop disc, an intermediate disc determining as a function of the lever position the kind of articulated joint rotation, a dampening element placed in a zone contacting said stop and intermediate discs, elastic means for transmitting motion from the lever and the determination of the position of said discs relative to each other, and a central pin about which the movement parts rotate.

8. The articulated joint according to claim 7, wherein said lever permits free rotation, frictioned rotation and locked rotation operating modes.

9. The articulated joint according to claim 7, wherein said lever rotates 45°.

10. The articulated joint according to claim 7, wherein said lever rotates along a 360° arc.

11. The articulated joint according to claim 7, wherein said watertight means are comprised of a watertight chamber placed in said central portion.

12. The articulated joint according to claim 7, wherein said watertight means are comprised of a hose connecting the front and rear ducts that can follow all the rotations of the articulated joint.

13. The articulated joint according to claim 7, further comprising a steam hub for the passage of the steam through the articulated joint, the steam hub being in said central portion between said front and rear ducts.

* * * * *